US011053709B2

(12) United States Patent
Thompson et al.

(10) Patent No.: US 11,053,709 B2
(45) Date of Patent: Jul. 6, 2021

(54) LATCH MECHANISM WITH ENGAGEMENT INDICIA

(71) Applicant: ASSA ABLOY Accessories and Door Controls Group, Inc., New Haven, CT (US)

(72) Inventors: Douglas Thompson, Somerset, PA (US); Vincent Baker, Rockwood, PA (US)

(73) Assignee: ASSA ABLOY Accessories and Door Controls Group, Inc., New Haven, CT (US)

( * ) Notice: Subject to any disclaimer, the term of this patent is extended or adjusted under 35 U.S.C. 154(b) by 659 days.

(21) Appl. No.: 15/956,147

(22) Filed: Apr. 18, 2018

(65) Prior Publication Data

US 2018/0305953 A1 Oct. 25, 2018

Related U.S. Application Data

(60) Provisional application No. 62/487,280, filed on Apr. 19, 2017.

(51) Int. Cl.
*E05B 15/02* (2006.01)
*E05B 63/06* (2006.01)
(Continued)

(52) U.S. Cl.
CPC ..... *E05B 15/024* (2013.01); *E05B 15/10* (2013.01); *E05B 47/0046* (2013.01);
(Continued)

(58) Field of Classification Search
CPC .... E05B 63/06; E05B 15/0053; Y10T 292/06; Y10S 292/60
See application file for complete search history.

(56) References Cited

U.S. PATENT DOCUMENTS 1,516,995 A * 11/1924 Trigueiro ..... E05B 65/0864 292/175
2,561,606 A 7/1951 Bates
(Continued)

OTHER PUBLICATIONS

International Search Report and Written Opinion for International Application No. PCT/US2018/028118, dated Jun. 29, 2018.
(Continued)

*Primary Examiner* — Mark A Williams
(74) *Attorney, Agent, or Firm* — Wolf, Greenfield & Sacks, P.C.

(57) ABSTRACT

A door latch slide for engagement with a strike plate in a doorjamb. The door latch slide comprises a latch slide body engageable with an actuator device mounted on the door for moving the latch slide toward and away from the strike plate, the latch slide body being adjustable with respect to the door to adjust extension distance toward the strike plate. A latchbolt extends from the latch slide body and has a non-flat sweep side for contacting an outside of the strike plate to cause retraction of the latchbolt away from the strike plate as the door is closing and an opposite flat face for contacting an inside of an opening in a face of the strike plate to prevent the door from opening when the latchbolt is extended toward and into the strike plate opening. The latchbolt has a pair of indicia on at least one side thereof, one of the indicia indicating a minimum desired distance for extension of the latchbolt into the strike plate opening and the other of the indicia indicating a maximum desired distance for extension. The latch slide may be adjusted during installation of the actuator device by visually extending the latchbolt into the strike plate opening, moving the latch slide body toward or away from the strike plate until the strike plate face is between the pair of indicia on the latchbolt, and setting the latch slide body with respect to the
(Continued)

actuator device so that the latchbolt when extended maintains the strike plate face between the pair of indicia on the latchbolt.

9 Claims, 7 Drawing Sheets

(51) Int. Cl.
*E05B 47/00* (2006.01)
*E05B 15/10* (2006.01)
*E05B 63/00* (2006.01)

(52) U.S. Cl.
CPC ..... *E05B 63/06* (2013.01); *E05B 47/0047* (2013.01); *E05B 63/0056* (2013.01); *E05B 2015/0275* (2013.01)

(56) References Cited

U.S. PATENT DOCUMENTS 2,581,606 A 1/1952 Seaman et al.
2,813,737 A 11/1957 Reiter
3,359,027 A * 12/1967 Schlage ..... E05B 59/00 292/222
3,792,887 A * 2/1974 Ramsey ..... E05C 1/08 292/169.21
4,372,594 A * 2/1983 Gater ..... E05B 63/06 292/1.5
4,711,477 A * 12/1987 Fann ..... E05B 63/06 292/1.5
4,711,480 A 12/1987 Horgan, Jr.
5,074,605 A * 12/1991 Fann ..... E05B 63/06 292/337
5,152,558 A * 10/1992 Smith ..... E05B 63/06 292/1.5
5,364,138 A * 11/1994 Dietrich ..... E05B 63/06 292/1.5
5,562,314 A * 10/1996 Wheatland ..... E05B 63/06 137/165
9,169,669 B2 10/2015 Clary et al.
2002/0093204 A1* 7/2002 Hartman ..... E05C 1/04 292/161
2008/0315596 A1* 12/2008 Terry ..... G09F 3/0317 292/327
2014/0239651 A1 8/2014 Shilts
2016/0215525 A1* 7/2016 Ramakrishna ..... E05C 1/163
2017/0022736 A1 1/2017 Nguyen
2017/0275926 A1* 9/2017 Kumar ..... E05B 55/12

OTHER PUBLICATIONS

[No Author Listed] Door Manual for CRL Panic Handle PA100A Series for All Glass Door, Blumcraft, a Division of C. R. Laurence Co., Inc. 2003, 24 pages.
International Preliminary Report on Patentability for International Application No. PCT/US2018/028118, dated Oct. 31, 2019.

* cited by examiner

LATCH MECHANISM WITH ENGAGEMENT INDICIA

RELATED APPLICATIONS

This application claims priority to U.S. patent application Ser. No. 62/487,280 filed on Apr. 19, 2017, the entire disclosure of which is incorporated herein by reference.

BACKGROUND OF THE INVENTION

1. Field of the Invention

The present invention relates generally to latch mechanisms for use in access devices, and more specifically, to an improved latch mechanism for facilitating installation and proper engagement between the latchbolt and strike.

2. Description of Related Art

A latchbolt or latch bolt is a common latch type, typically part of a lockset, comprising a spring-loaded bolt with an angled edge. When a door is closed, the angled edge of the latchbolt engages with the lip of a strike plate. A spring allows the bolt to retract, and once the door is fully closed, the bolt automatically extends into the strike plate. Typically, the latchbolt is disengaged or retracted when a user turns a door handle which, via the lockset's mechanism, manually retracts the latchbolt, allowing the door to open.

Vertical rod door latches are door latches commonly used in commercial or public buildings where the door latches are located at the top and/or bottom edge of the door. Vertical rod door latches typically include one or more latches or catches that extend upward out of the top and/or downward from the bottom edge of the door into a corresponding opening in a strike located in the door frame above the door or on the floor below the door.

The latches are most commonly driven into and out of engagement with the corresponding strike by vertical rods extending from an actuator located near the midpoint of the door to the top and/or bottom latches. The vertical rods extending from the actuator may be hidden inside the door or located on the surface of the door and they may drive the latches at each point with either a pulling or pushing motion. For a glass door, the vertical rod and actuator is typically concealed in push/pull bar or rail extending along at least a portion of the length of the glass panel.

The actuator most commonly used to drive the latch points of a vertical rod door latch includes a lever handle, or a pushbar or pushrail type exit device. An "exit device" is a lock mechanism operated from the inside of an exit door through the use of a crossbar, pushbar, pushrail, panic bar or paddle actuator that moves towards the exit door to retract the latchbolt when pressure is applied.

Typically, the depth of latch projection into the strike is set before a door is installed and final adjustments require the door to be taken down and re-adjusted, then installed again. Installation and proper engagement between the latchbolt and strike can be problematic, particularly in latch mechanisms used in exit devices for glass doors. If the latchbolt protrudes too far into the strike, too much force may be required to retract the latch. Conversely, if the latchbolt does not protrude far enough into the strike, it may be possible to open the door with sufficient force, even if the latch is not retracted. Moreover, with respect to glass panel doors, typical latchbolt configurations can result in additional security issues, as the flexibility of the glass under force may result in latchbolt failure.

Therefore, a need exists for an improved latch mechanism for facilitating installation and proper engagement between the latchbolt and the strike.

SUMMARY OF THE INVENTION

Bearing in mind the problems and deficiencies of the prior art, it is therefore an object of the present invention to provide an improved latch mechanism for facilitating installation and proper engagement between the latchbolt and the strike.

It is another object of the present invention to provide a latchbolt including a pair of visible indicia on a side thereof, one of the indicia indicating a minimum desired distance of extension of the latchbolt inside the strike plate opening and the other of the indicia indicating a maximum desired distance of extension of the latchbolt inside the strike plate opening.

It is yet another object of the present invention to provide a latchbolt having a non-flat sweep side for contacting an outside surface of a strike plate to cause retraction of the latchbolt, and an opposite flat face for contacting an inside surface of an opening in a face of the strike plate to prevent the door from opening when the latchbolt is extended.

A further object of the present invention is to provide a latchbolt which prevents point contact with the inside of the strike plate opening and reduces the force required to retract the latchbolt when the latchbolt face is in contact with the inside of the strike plate opening.

Still another object of the present invention is to provide a latchbolt that reduces opening and closing forces of the door during contact between the latchbolt and strike plate.

Still other objects and advantages of the invention will in part be obvious and will in part be apparent from the specification.

The above and other objects, which will be apparent to those skilled in the art, are achieved in the present invention which is directed to a door latch slide for engagement with a strike plate in a doorjamb. The door latch slide comprises a latch slide body engageable with an actuator device mounted on the door for moving the latch slide toward and away from the strike plate, the latch slide body being adjustable with respect to the door to adjust extension distance toward the strike plate, and a latchbolt extending from the latch slide body, the latchbolt having a non-flat sweep side for contacting an outside of the strike plate to cause retraction of the latchbolt away from the strike plate as the door is closing and an opposite flat face for contacting an inside of an opening in a face of the strike plate to prevent the door from opening when the latchbolt is extended toward and into the strike plate opening. The latchbolt has a pair of indicia on a side thereof, one of the indicia indicating a minimum desired distance of extension of the latchbolt inside the strike plate opening and the other of the indicia indicating a maximum desired distance of extension of the latchbolt inside the strike plate opening. The latch slide may be adjusted during installation of the actuator device by visually extending the latchbolt into the strike plate opening, moving the latch slide body toward or away from the strike plate until the strike plate face is between the pair of indicia on the latchbolt, and setting the latch slide body with respect to the actuator device so that the latchbolt when extended maintains the strike plate face between the pair of indicia on the latchbolt.

The latchbolt may have opposite sides between the sweep side and flat face, wherein the indicia is visible on at least one of the opposite sides of the latchbolt. The pair of indicia may comprise visible parallel lines extending perpendicular to direction of movement of the latch slide body, and the visible parallel lines may be engraved in a side of the latchbolt.

In another aspect, the present invention is directed to a method of adjusting a door latch slide for engagement with a strike plate in a doorjamb. The method comprises providing a door latch slide having a latch slide body engageable with an actuator device mounted on the door for moving the latch slide toward and away from the strike plate, the latch slide body being adjustable with respect to the door to adjust extension distance toward the strike plate, and providing a latchbolt extending from the latch slide body, the latchbolt having a non-flat sweep side for contacting an outside of the strike plate to cause retraction of the latchbolt away from the strike plate as the door is closing and an opposite flat face for contacting an inside of an opening in a face of the strike plate to prevent the door from opening when the latchbolt is extended toward and into the strike plate opening, the latchbolt having a pair of indicia on a side thereof, one of the indicia indicating a minimum desired distance of extension of the latchbolt inside the strike plate opening and the other of the indicia indicating a maximum desired distance of extension of the latchbolt inside the strike plate opening. The method further comprises providing an actuator device mounted on the door for moving the latch slide toward and away from the strike plate, installing the door latch slide in the actuator device, and adjusting the latch slide with respect to the actuator device by: visually extending the latchbolt into the strike plate opening, moving the latch slide body toward or away from the strike plate until the strike plate face is between the pair of indicia on the latchbolt, and setting the latch slide body with respect to the actuator device so that the latchbolt when extended maintains the strike plate face between the pair of indicia on the latchbolt.

In still another aspect, the present invention is directed to a door latch slide for engagement with a strike plate in a doorjamb, comprising a latch slide body engageable with an actuator device mounted on the door for moving the latch slide toward and away from the strike plate, and a latchbolt extending from the latch slide body. The latchbolt has a non-flat sweep side for contacting an outside of the strike plate to cause retraction of the latchbolt away from the strike plate as the door is closing, an opposite flat face for contacting an inside of an opening in a face of the strike plate to prevent the door from opening when the latchbolt is extended toward and into the strike plate opening, and opposite sides between the sweep side and flat face. The latchbolt flat face has beveled edges along the latchbolt opposite sides, wherein when the latch slide moves from the door toward the strike plate, and the latchbolt is extended into the strike plate opening, the beveled edges prevent point contact with the inside of the strike plate face opening and reduce force required to retract the latch slide when the latch face is in contact with the inside of the strike plate face opening.

The latchbolt face may be planar and the beveled edges along the opposite sides of the latchbolt face may comprise curved surfaces between the latchbolt face and the latchbolt opposite sides. The latchbolt may further have a curved surface between the end of the latchbolt face and the non-flat sweep side.

The latchbolt may further include a pair of indicia on a side thereof, one of the indicia indicating a minimum desired distance of extension of the latchbolt inside the strike plate opening and the other of the indicia indicating a maximum desired distance of extension of the latchbolt inside the strike plate opening.

In still yet another aspect, the present invention is directed to a door latch slide for engagement with a strike plate in a doorjamb, comprising a latch slide body engageable with an actuator device mounted on the door for moving the latch slide toward and away from the strike plate, and a latchbolt extending from the latch slide body, the latchbolt having a non-flat sweep side for contacting an outside of the strike plate to cause retraction of the latchbolt away from the strike plate as the door is closing and an opposite flat face for contacting an inside of an opening in a face of the strike plate to prevent the door from opening when the latchbolt is extended toward and into the strike plate opening. The latchbolt has a first radius at an end thereof between the flat face and the sweep side and a second radius at the sweep side, the second radius being greater than the first radius. The latchbolt has a surface between the flat face and the sweep side with a smooth transition between the first and second radii, wherein the latchbolt first and second radii and the smooth surface transition therebetween reduce opening and/or closing forces of the door during contact between the latchbolt and the strike plate.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE EMBODIMENT(S)

Figure 1:
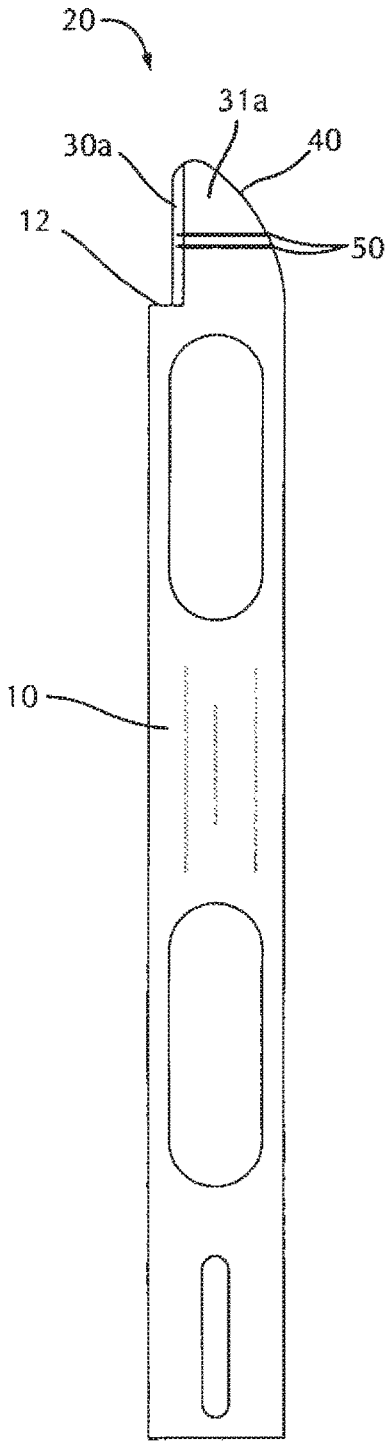
FIGS. 1 and 2 are side plan views of a latchbolt and latch body according to an embodiment of the present invention.
Figure 2:
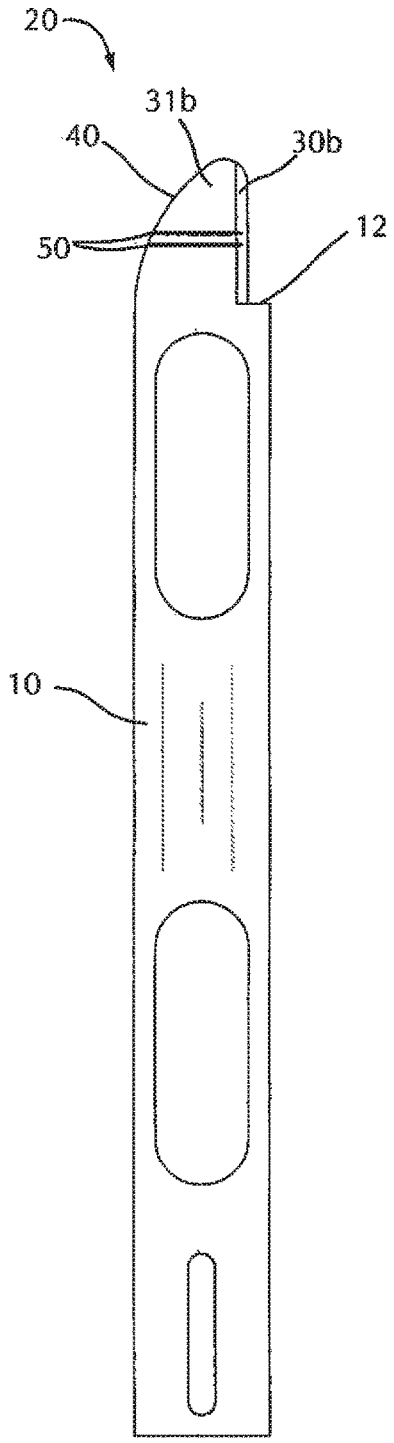
Figure 3:
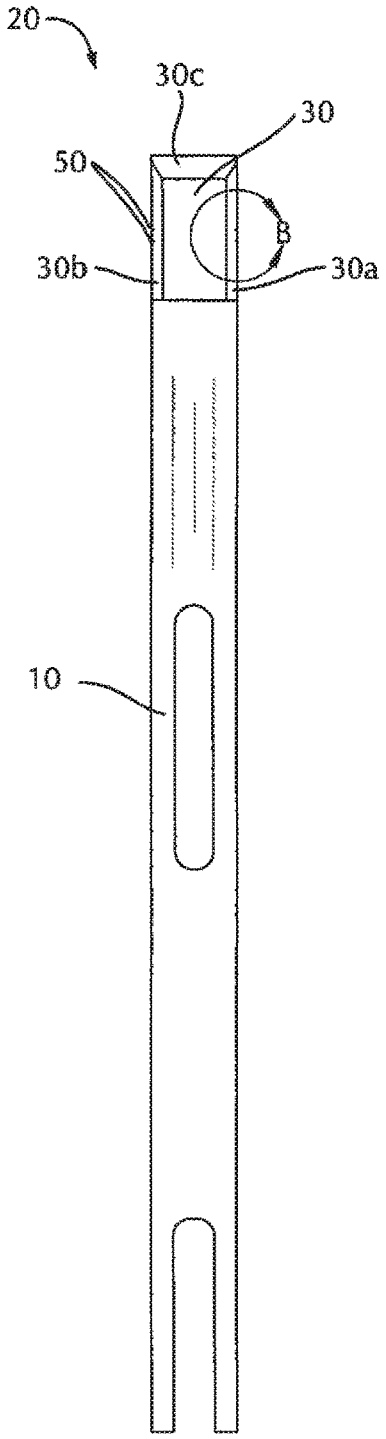
FIG. 3 is a front plan view of the latchbolt and latch body shown in FIGS. 1-2.

In describing the embodiments of the present invention, reference will be made herein to FIGS. 1-19 of the drawings in which like numerals refer to like features of the invention.

Certain terminology is used herein for convenience only and is not to be taken as a limitation of the invention. For example, words such as "upper," "lower," "left," "right," "horizontal," "vertical," "upward," and "downward" merely describe the configuration shown in the drawings. For purposes of clarity, the same reference numbers may be used in the drawings to identify similar elements.

Additionally, in the subject description, the word "exemplary" is used to mean serving as an example, instance or illustration. Any aspect or design described herein as "exemplary" is not necessarily intended to be construed as preferred or advantageous over other aspects or design. Rather, the use of the word "exemplary" is merely intended to present concepts in a concrete fashion.

Referring now to FIGS. 1-4, an embodiment of the latch mechanism or door slide of the present invention is shown. As shown in FIGS. 1-4, the latch mechanism or door slide 20 comprises a latch slide body 10 engageable with an actuator device mounted on a door (not shown) for moving the latch mechanism or slide toward or away from a strike plate, and a latchbolt 12 extending from the latch slide body. Latch body 10 is adjustable with respect to the door to adjust the extension or projection distance toward the strike plate. Latchbolt 12 includes an angled or non-flat sweep side 40 for contacting the outside surface of the strike plate to cause retraction of the latchbolt away from the strike plate as the door is closing, and an opposite face 30 for contacting the inside of an opening in a face of the strike plate to prevent the door from opening when the latchbolt 12 is extended into the strike plate opening. In an embodiment, face 30 may be flat or otherwise planar. As shown in FIGS. 1-4, the sweep side 40 is rounded or curved, but it should be understood by those skilled in the art than any otherwise non-flat surface on the sweep side of the latchbolt is also within the intended scope of the present invention.

Typically, the depth of latch projection into the strike is set before a door is installed and final adjustments require the door to be taken down and re-adjusted, then installed again. Installation and proper engagement between the latchbolt and strike can be problematic, particularly in latch mechanisms used in exit devices for glass doors. If the latchbolt protrudes too far into the strike, too much force may be required to retract the latch. Conversely, if the latchbolt does not protrude far enough into the strike, it may be possible to open the door with sufficient force, even if the latch is not retracted.

Figure 4:
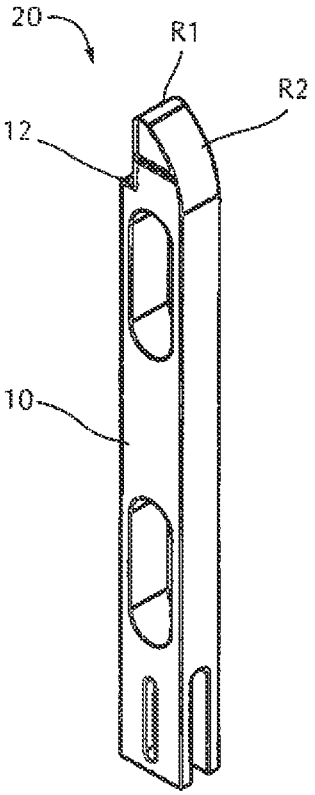
FIG. 4 is a perspective view of the latchbolt and latch body shown in FIGS. 1-3.
Figure 5:
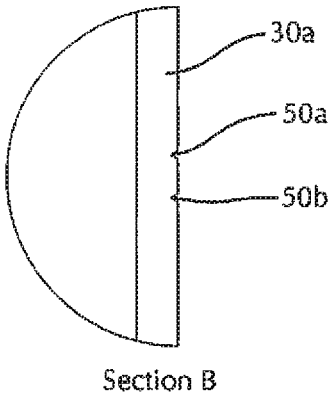
FIG. 5 is a magnified plan view of Section B of FIG. 3.
Figure 6:
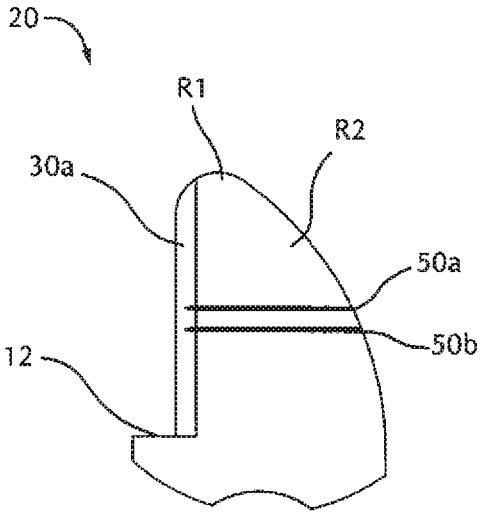
FIG. 6 is a side plan view of a latchbolt according to an embodiment of the present invention.
Figure 7:
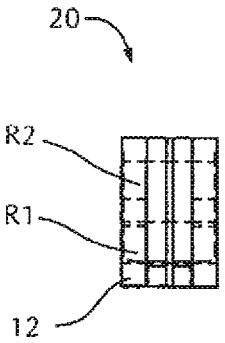
FIGS. 7 and 8 are top plan views of the latchbolt of FIG. 6.
Figure 8:
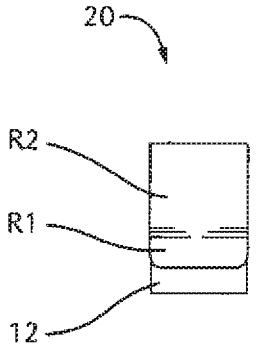

The latch mechanism of the present invention facilitates installation and proper engagement between the latchbolt and strike plate by including a visual indicator to aid the installer. As shown in FIGS. 1 and 4, and more particularly in FIG. 6, latchbolt 12 comprises a pair of indicia 50*a*, 50*b* visible on at least one side thereof. As shown, indicia 50*a*, 50*b* may comprise a set of parallel lines extending perpendicular to the direction of movement of the latch body 10. Indicia 50*a* represents a minimum desired distance for extension or protrusion of the latchbolt 12 into the strike plate opening, and indicia 50*b* represents a maximum desired distance for extension or protrusion. In one embodiment, indicia 50*a*, 50*b* may be etched or engraved into the side of latchbolt 12. In other embodiments, indicia 50*a*, 50*b* may be printed or otherwise inscribed onto a side surface of the latchbolt, such that the indicia are clearly visible to the installer.

Adjustment of the latch mechanism with respect to the actuator device comprises visually extending the latchbolt 12 into the strike plate opening, moving the latch body 10 toward or away from the strike plate until the face of the strike plate is between the pair of indicia 50*a*, 50*b* on the latchbolt, and setting the latch body 10 with respect to the actuator device such that, when extended, the latchbolt 12 maintains the face of the strike plate between indicia 50*a*, 50*b*.

Figure 9:
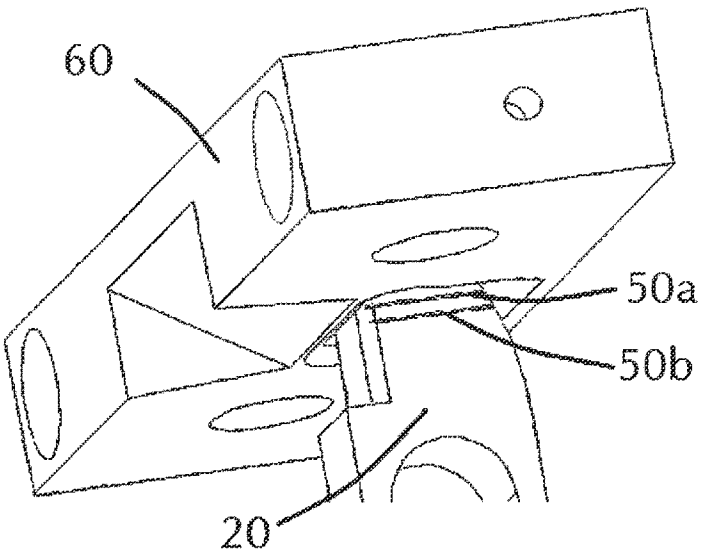
FIGS. 9-12 show an embodiment of the latchbolt of the present invention in various states of engagement with a strike plate in a door jamb.
Figure 10:
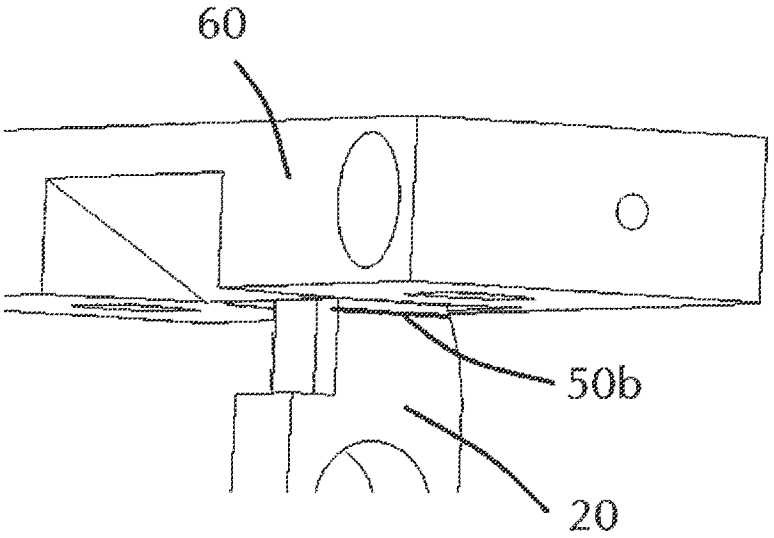
Figure 11:
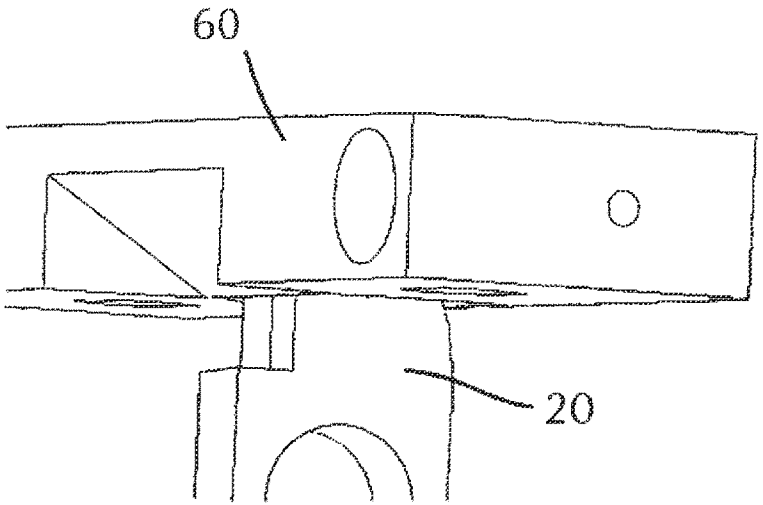
Figure 12:
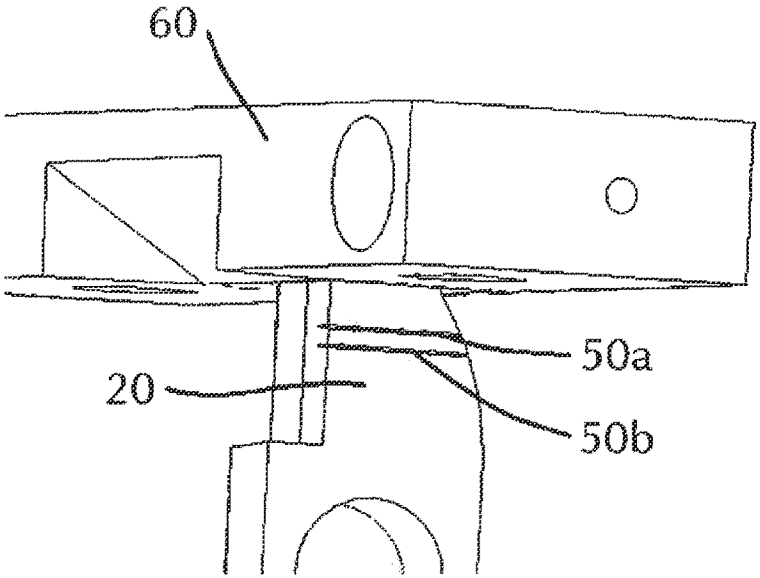

FIGS. 9-12 show the latch mechanism 20 of the present invention in various states of engagement with a strike plate in a door jamb. As shown in FIG. 11, latchbolt 12 is engaged with the strike plate 60 at a distance in excess of indicia 50*b*, thereby increasing the force required to retract the latchbolt, likely beyond what is desired for operation. Conversely, FIG. 12 shows too little engagement, such that the latchbolt projects into the strike plate opening at a distance less than as marked by indicia 50*a*, thereby possibly allowing the door to be opened with sufficient force, even if the latch is not retracted. FIGS. 9 and 10 depict a proper engagement, such that the face of the strike plate 60 is positioned and maintained between indicia 50*a* and 50*b* on the latchbolt 12. FIG. 9 shows the strike plate from below and at a slightly upward angle, such that it can more clearly be seen that the face of the strike plate is maintained between indicia 50*a*, 50*b* during proper engagement of the latchbolt, while FIG. 10 shows a substantially planar view of the latchbolt and strike plate of FIG. 9.

Referring again to FIGS. 1-3, latchbolt 12 further comprises opposite sides 31*a*, 31*b* between the flat face 30 and the angled or non-flat sweep side 40, wherein the latchbolt flat face 30 comprises beveled edges 30*a*, 30*b* along the opposite sides. When the latch mechanism or latch slide 20 moves from the door toward the strike plate 60, and the latchbolt 12 is thereby extended into the strike plate opening, the beveled edges 30*a*, 30*b* prevent point contact with the inside of the strike plate opening and reduce the force required to retract the latch mechanism when the latch flat face 30 is in contact with the inside of the strike plate opening. By comparison, the straight or "squared-off" edges typically used in latchbolts of the prior art can cause the latchbolt to dig into the sides of the strike plate opening if force is applied to the door while the latch is engaged.

Figure 19:
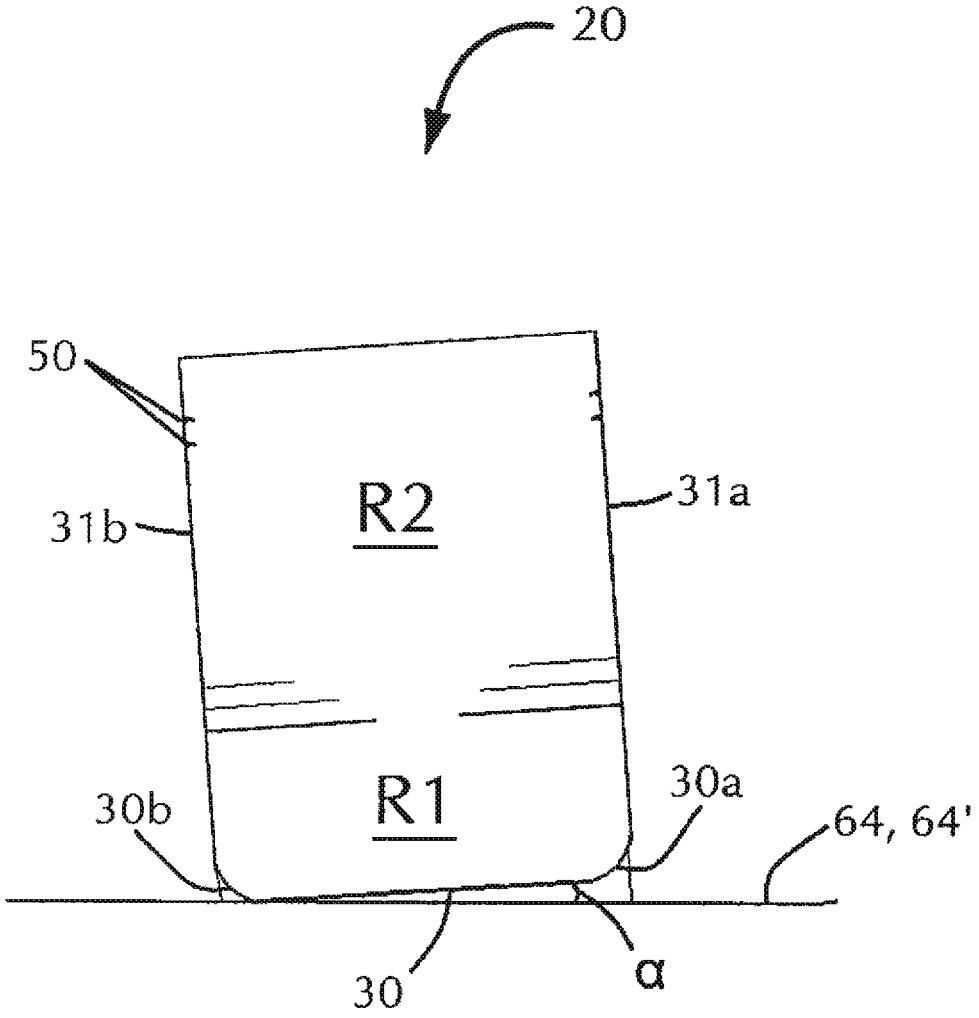
FIG. 19 is a top plan view of an embodiment of the latchbolt of the present invention extended into and contacting the inside of a strike plate opening.

As shown in FIG. 19, latchbolt 20 has a planar face 30 between opposite latchbolt sides 31*a*, 31*b*. At the corners between planar face 30 and opposite latchbolt sides 31*a*, 31*b* there are beveled, angled surfaces 30*a*, 30*b*, respectively. In the embodiment shown, these surfaces are curved with a desired radius, but it should be understood by those skilled in the art than any otherwise non-flat surface is also within the intended scope of the present invention. Because a door and the attached latchbolt may warp during service and opening of the door, instead of being parallel and flush in full contact with the inside of the strike plate opening, face 30 may be disposed at a slight angle $\alpha$ to the strike plate opening 64, 64' (shown in FIG. 19 at an exaggerated angle). Prior latchbolts have essentially square corners that would make point contact with the strike plate opening when positioned at the angle shown, and possibly cause scoring of the strike plate and consequently additional force to be required to retract the latch. The curved edges 30*a*, 30*b* at the corners of the latchbolt face 30 in the present invention present non-point contact, over a limited area, with strike plate opening 64, 64', which reduces and/or prevents such scoring and additional forces on the latchbolt during retraction.

Figure 14:
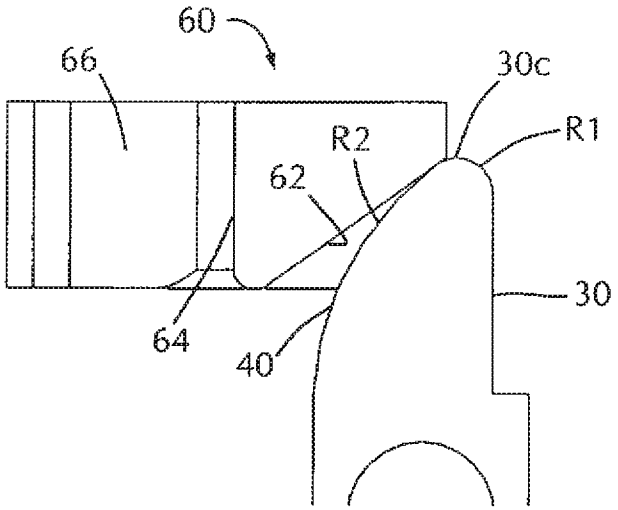
FIGS. 13-15 show an embodiment of the latchbolt of the present invention transitioning from a latching position to a latched position with a manual strike.
Figure 15:
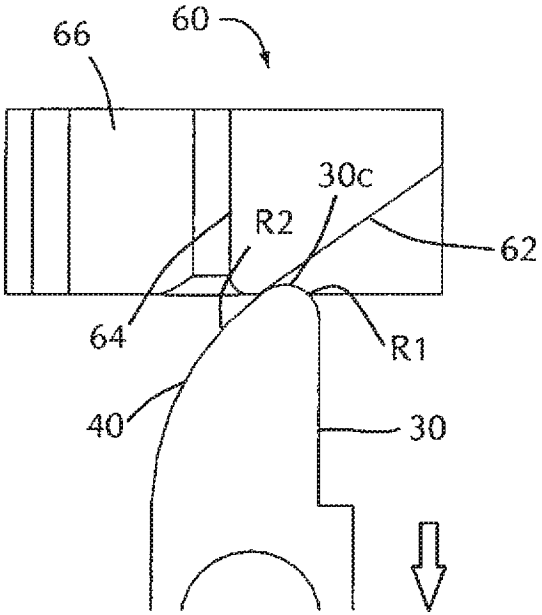
Figure 13:
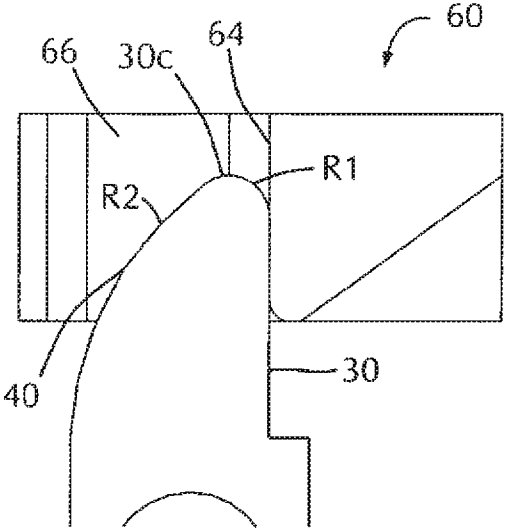
Figure 17:
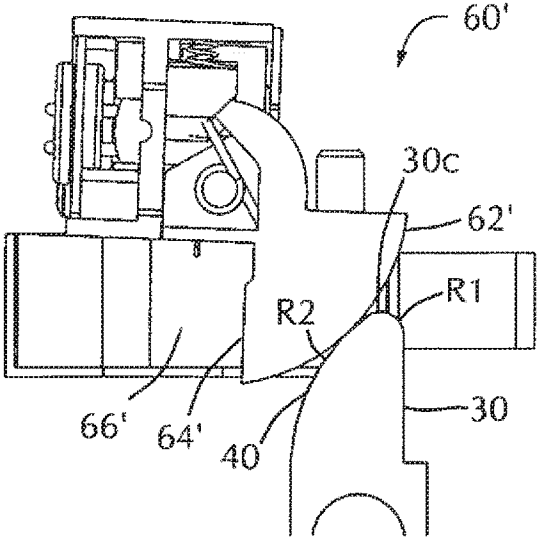
FIGS. 16-18 show an embodiment of the latchbolt of the present invention transitioning from a latching position to a latched position with an electric strike.
Figure 16:
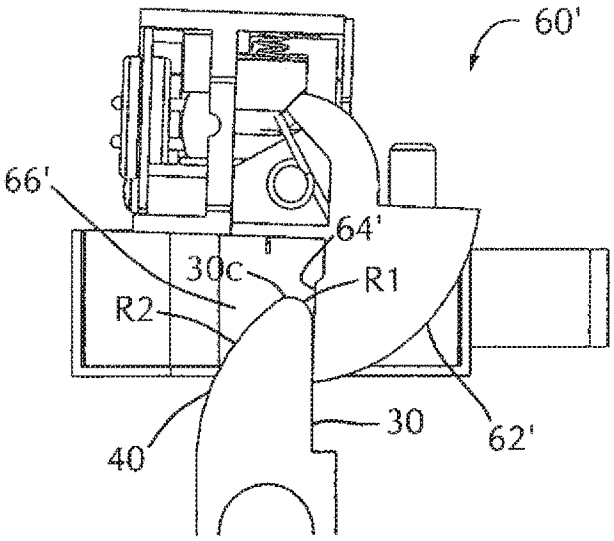
Figure 18:
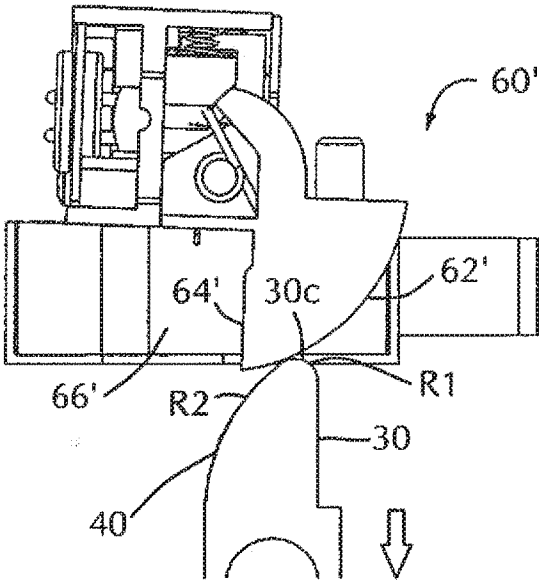

As best shown in FIGS. 4 and 6-8, latchbolt 12 further comprises a first radius R1 at one end between flat face 30 and angled sweep side 40, and a second radius R2 defining sweep side 40, wherein R2 is greater than R1. In an embodiment, R1 may be about ⅛" and R2 may be about 1", so as to enable the latchbolt to operate with either a manual strike 60, as shown in FIGS. 13-15, or an electric strike 60', as shown in FIGS. 16-18. With a sweep side radius R2 of about 1", approximately 4.5 lbs of force is required to open the latch, which is within Americans with Disability Act (ADA) guidelines for interior doors. It should be understood by those skilled in the art that R1 and R2 are shown as about ⅛" and about 1", respectively, for exemplary purposes only, and that different radii may also be used in accordance with design requirements.

Latchbolt 12 further has a surface 30*c* at an upper end of the latchbolt between face 30 and sweep side 40 defining a smooth transition between radii R1, R2. Referring now to FIGS. 13-18, an embodiment of the latchbolt of the present invention is shown transitioning from a latching position to a latched position with a manual strike (FIGS. 13-15) and an electric strike (FIGS. 16-18), respectively. In FIGS. 13 and 16, the door (not shown) is closed and the latchbolt is in the fully extended and locked position within strike plate opening 66, 66', so that face 30 contacts strike plate inside opening 64. Prior to this position, as shown in FIGS. 14 and 17, as the door is closing, the latchbolt sweep side 40 contacts the outside of the strike plate 62, 62' and as it is pushed to the right, the angle of sweep side 40, assisted by the angle of strike plate outside 62, causes the latchbolt to retract downward. Initially, the portion of sweep side 40 having radius R2 makes sliding contact with strike plate outside surface 62, 62'. FIGS. 15 and 18 show the latchbolt almost fully retracted downward as the door continues to close, so that the transition surface 30*c* between R1 and R2 makes sliding contact with strike plate outside 62, 62'. As the latchbolt goes beyond its upper end point and surface 30*c* is in contact with the strike plate, the portion of latchbolt having smaller radius R1 will contact the strike plate as the latchbolt is urged upward into the extended position within the strike plate opening 66, 66'. Radii R1, R2 and the smooth transition surface 30*c* therebetween, reduce opening and closing forces on the door during contact between latchbolt 12 and the strike plate 60.

Thus, the present invention achieves one or more of the following advantages. The present invention provides an improved latch mechanism for facilitating installation and proper engagement between the latchbolt and the strike, comprising a latchbolt including a pair of visible indicia on at least one side thereof, one of the indicia indicating a minimum desired distance for extension of the latchbolt inside the strike plate opening and the other of the indicia indicating a maximum desired distance for extension. Proper engagement of the latchbolt can be determined by visually extending the latchbolt into the strike plate opening, moving the latch slide body toward or away from the strike plate until the strike plate face is between the pair of indicia on the latchbolt, and setting the latch slide body with respect to the actuator device so that the latchbolt when extended maintains the strike plate face between the pair of indicia on the latchbolt. A non-flat sweep side of the latchbolt contacts an outside surface of a strike plate to cause retraction of the latchbolt as the door is moved toward a closed position, and an opposite flat face contacts an inside surface of an opening in a face of the strike plate to prevent the door from opening when the latchbolt is extended. The latchbolt further has beveled edges between the flat face and the non-flat sweep side which provide non-point contact, over a limited surface area, with the inside of the strike plate opening and reduce the force required to retract the latchbolt when the latchbolt face is in contact with the inside of the strike plate opening.

While the present invention has been particularly described, in conjunction with specific embodiments, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A door latch slide for engagement with a strike plate in a doorjamb, the door latch slide comprising:

a latch slide body engageable with an actuator device mounted on the door for moving the latch slide toward and away from the strike plate, the latch slide body being adjustable with respect to the door to adjust an extension distance of the latch slide body toward the strike plate;

a latchbolt extending from the latch slide body, the latchbolt having a non-flat sweep side for contacting an outside of the strike plate to cause retraction of the latchbolt away from the strike plate as the door is closing and the latchbolt having an opposite flat face located on a slide of the latchbolt opposite the non-flat sweep side, the opposite flat face configured for contacting an inside of an opening in a face of the strike plate to prevent the door from opening when the latchbolt is extended toward and into the strike plate opening;

the latchbolt having a pair of indicia on at least one side thereof, one of the indicia indicating a minimum desired extension distance for extension of the latchbolt inside the strike plate opening, and the other of the indicia indicating a maximum desired extension distance for extension of the latchbolt inside the strike plate opening, wherein the latch slide may be adjusted during installation of the actuator device by visually extending the latchbolt into the strike plate opening, moving the latch slide body toward or away from the strike plate until the strike plate face is between the pair of indicia on the latchbolt, and setting the latch slide body with respect to the actuator device so that the latchbolt, when extended, maintains the strike plate face between the pair of indicia on the latchbolt.

2. The door latch slide of claim 1 wherein the latchbolt has opposite sides between the sweep side and flat face, and wherein the indicia is visible on at least one of the opposite sides of the latchbolt.

3. The door latch slide of claim 1 wherein the pair of indicia comprise visible parallel lines extending perpendicular to a direction of movement of the latch slide body.

4. The door latch slide of claim 1 wherein the visible parallel lines are engraved in a side of the latchbolt.

5. The door latch slide of claim 1 wherein the latchbolt has opposite sides between the sweep side and flat face, the latchbolt flat face having beveled edges along the latchbolt opposite sides.

6. The door latch slide of claim 5 wherein the latchbolt flat face beveled edges present non-point contact over a limited area with an inner surface of the strike plate opening during retraction and extension of the latchbolt into the strike plate opening.

7. The door latch slide of claim 1 wherein the latchbolt comprises a first radius at one end between the latch bolt flat face and non-flat sweep side, and a second radius defining the non-flat sweep side, wherein the second radius is greater than the first radius.

8. The door latch slide of claim 7 further including an upper surface at an end of the latchbolt between the latchbolt flat face and non-flat sweep side, the latchbolt upper surface defining a smooth transition between the first radius and the second radius, wherein the latchbolt first and second radii and the smooth surface transition therebetween reduce opening and/or closing forces of the door during contact between the latchbolt and the strike plate.

9. The door latch slide of claim 7 wherein the latchbolt first radius is about ⅛" and the latchbolt second radius is about 1".

* * * * *